United States Patent [19]

Ishihara

[11] 4,140,100

[45] Feb. 20, 1979

[54] INFRARED HEATER

[76] Inventor: Masamitsu Ishihara, 628 Hirai, Kannami-cho, Tagata-gun, Shizuoka-ken, Japan

[21] Appl. No.: 800,547

[22] Filed: May 25, 1977

[30] Foreign Application Priority Data

Sep. 22, 1976 [JP] Japan ..... 51-125657[U]

[51] Int. Cl.[2] ..... F24C 3/04

[52] U.S. Cl. ..... 126/92 B; 431/328

[58] Field of Search ..... 126/92 R, 92 AC, 92 B, 126/91 R, 91 A; 431/328, 329

[56] References Cited

U.S. PATENT DOCUMENTS

| | | | |
|---|---|---|---|
| 1,216,848 | 2/1917 | Schmidt | 126/92 B |
| 2,980,104 | 4/1961 | Patrick et al. | 431/328 |
| 3,503,379 | 3/1970 | Kuhn et al. | 431/328 |

FOREIGN PATENT DOCUMENTS

| | | | |
|---|---|---|---|
| 458277 | 4/1928 | Fed. Rep. of Germany | 126/92 B |

*Primary Examiner*—Carroll B. Dority, Jr.

[57] ABSTRACT

An infrared heater comprises a mirror-like reflecting plate, a combustion cylinder disposed in front of the reflecting plate, and a radiating cylinder disposed concentrically around the combustion cylinder. On the peripheral surface of the inner combustion cylinder are bored a plurality of apertures, while on the peripheral surface of the outer radiating cylinder are formed a plurality of apertures in offset positions in no radial alignment with the apertures of the combustion cylinder.

5 Claims, 4 Drawing Figures

INFRARED HEATER

BACKGROUND OF THE INVENTION

This invention relates to an infrared heater as it is called.

The conventional so-called infrared heater ignites liquid fuel such as kerosene or kerosene oil ejected from a burner means including a blower and a nozzle, and strikes the resultant jet flame against a radiating plate disposed in front of the burner means to heat such radiating plate, thereby radiating infrared rays outward from the radiating plate to heat the ambient air. Such conventional infrared heater, however, strikes the jet flame from the burner means directly against the radiating plate, so that the radiating plate is not heated uniformly but only partially and its temperature is liable to rise excessively, making the temperature control of the radiating plate difficult. Further, the jet flame is blown off from apertures bored in the radiating plate, which will lead to danger as well as to objectionable appearance. The known infrared heater is additionally defective in that it requires a long time for fully heating the ambient air because of its relatively narrow angle of radiation.

SUMMARY OF THE INVENTION

It is therefore an object of this invention to provide an infrared heater capable of heating the ambient air effectively in a short period of time without causing any blow off of the jet flame which may overheat the radiating plate, considering the aforementioned drawbacks in the prior art.

In order to attain the above object, the infrared heater according to one preferred embodiment of this invention has a multilayer cylinder means lying in front of a semicylindrical mirror-like reflecting plate. The multilayer cylinder means is composed of an inner combustion cylinder and an outer radiating cylinder having a plurality of apertures bored in their respective peripheral surfaces and arranged concentrically. The apertures bored in the outer radiating cylinder are not in alignment with the apertures of the inner combustion cylinder radially and are arranged in offset positions. A jet flame is ejected from a burner means at the side of the multilayer cylinder means into the combustion cylinder in the axial direction of the multilayer cylinder means. Since the ejecting direction of the jet flame is perpendicular to the axial direction of the apertures of the combustion cylinder, the combustion cylinder may be heated fully all over the surface with a little blowoff of jet flame through the apertures. As for the apertures of the radiating cylinder surrounding the combustion cylinder, they are not radially in alignment with the apertures of the combustion cylinder, so that the radiating cylinder may be heated fully without causing any blowoff of the jet flame through the apertures of the combustion cylinder to the outside. Further, the radiating cylinder may be heated extensively and sufficiently, so that it may assure wide-ranging radiation for high-temperature and short-time heating of the ambient air with the assistance of the mirror-like reflecting plate at the back thereof.

The above and further objects and novel features of the invention will more fully appear from the following detailed description when the same is read in connection with the accompanying drawings. It is to be expressly understood, however, that the drawings are for purpose of illustration only and are not intended as a definition of the limits of the invention.

DETAILED DESCRIPTION OF THE PREFERRED EMBODIMENT

Figure 1:
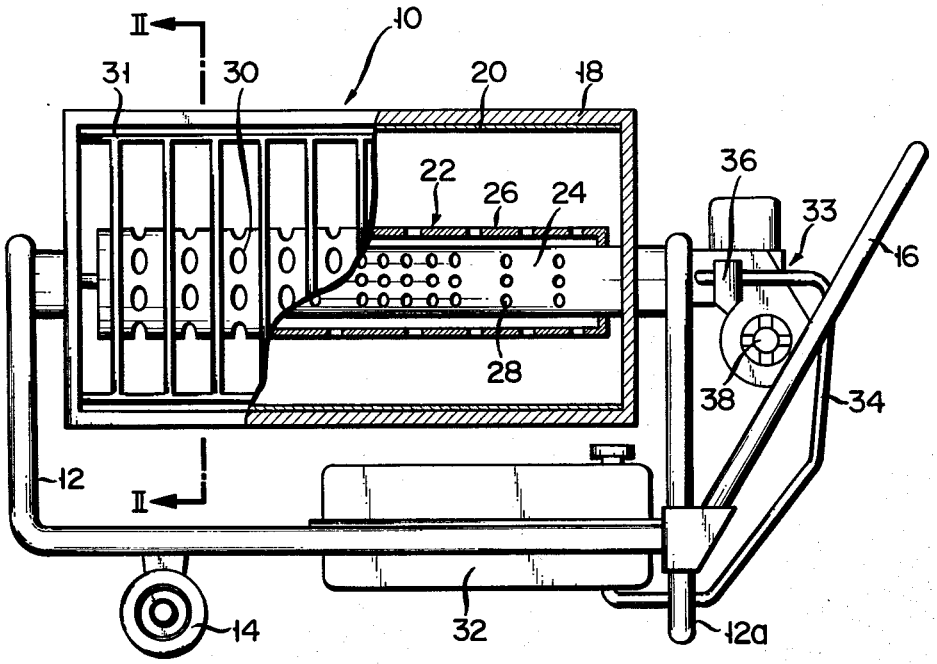
FIG. 1 is a partially broken front view of the infrared heater according to one preferred embodiment of the invention.

As shown in FIG. 1, the infrared heater 10 according to this invention comprises a frame 12 composed of a pipe member having a pair of casters 14 attached to the base thereof and one end coupled with a gate-type handle arm 16 to be operated at time of shifting. The bottom end of the frame 12 forms a pair of holdfast portions **12*a* bent inward from opposite directions at the lower portion of the handle arm 16 so that, in using the installed infrared heater 10**, such holdfast portions may be grounded to prevent the heater from moving.

Figure 2:
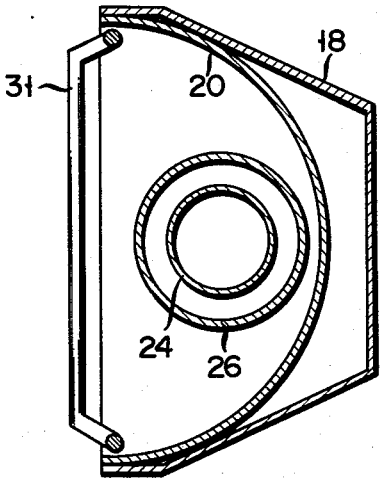
FIG. 2 is a sectional view taken along line II—II of FIG. 1.

As may be clear from FIG. 2, the frame 12 is equipped with a box-like housing 18 on the inside face of which a semicylindrical mirror-like reflecting plate 20 is fixed. Further, a multilayer cylinder means 22 is contained within the housing 18. This multilayer cylinder means 22 includes a combustion cylinder 24 into which a jet flame is introduced by a burner means (mentioned hereinafter) and a radiating cylinder 26 disposed concentrically around such combustion cylinder. On the peripheral surface of the inner combustion cylinder 24 are bored a plurality of apertures 28, while on the peripheral surface of the outer radiating cylinder 26 are bored a plurality of apertures 30 arranged in non alignment with the apertures 28 of the combustion cylinder radially or in offset positions. Across the opening of the housing 18 is provided a safety net guard 31 for preventing operator from touching directly the multilayer cylinder means 22 which may be heated for radiation.

A fuel tank 32 is located below the frame 12, and a fuel hose 34 extends from such fuel tank to a known burner means 33 disposed beside the multilayer cylinder means 22. The burner means 33 includes an electromagnetic pump 36 for sucking fuel through the fuel hose 34 and a blower 38 to blowoff the sucked fuel from a nozzle (not shown) into the combustion cylinder 24.

Figure 3:
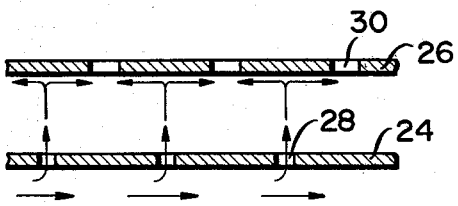
FIG. 3 is a partial longitudinal sectional view of the multilayer cylinder means.
Figure 4:
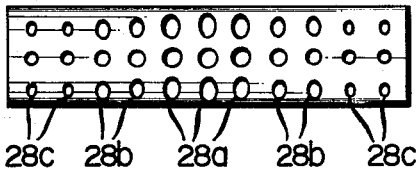
FIG. 4 is an enlarged front view illustrating a modification of the combustion cylinder.

The operation of the infrared heater 10 with the aforementioned construction will now be explained below. First, the heater 10 is moved to the desired position, rolling the casters 14 by applying a lateral force to the heater with the handle arm 16 so lifted up as to raise the holdfast portions **12*a*. Then the heater 10 is fixed in position by bringing down the handle arm 16 to ground the holdfast portions 12*a*. Since the holdfast portions 12*a* extend in a direction perpendicular to the rolling direction of the casters 14, there may be secured satisfactory setting resistance. When the electromagnetic motor 36 is excited for operation after the heater is installed in the desired position, the fuel such as kerosene oil is delivered from the fuel tank 32 through the fuel hose 34 to the blower 38, where such fuel, in the form of a spray, is further ejected into the combustion cylinder 24 through the nozzle (not shown). The ejected spray of kerosene oil is ignited by an ignition plug (not shown) disposed in front of the nozzle to form a flame. Since such flame extends in the same direction with the axis of the combustion cylinder 24, the peripheral surface of the combustion cylinder is heated extensively and satisfactorily, allowing only a little portion of the jet flame to be blown off through the apertures 28. The jet flame heats the combustion cylinder 24 fully, the outer radiating cylinder 26 is heated red-hot indirectly by the heated air within the space between it and the combustion cylinder and directly by the flame blown off through the apertures 28, and such red-hot radiating cylinder 26 radiates infrared rays to the open air. The infrared rays from the front of the radiating cylinder 26 are radiated forward, while the infrared rays from the top, bottom and back of the radiating cylinder 26 are reflected by the backward mirror-like reflecting plate and then radiated forward, thereby heating the ambient air through a wide angle of radiation quickly to a high temperature. The apertures 30 bored in the radiating cylinder 26, as may be clear from FIG. 3, are located in the offset positions in non radial alignment with the apertures 28 of the combustion cylinder 24, so that there may be no flame through the apertures 28 blown off to the open air through the apertures 30. Meanwhile, the flame through the apertures 28 strikes against the inside wall of the radiating cylinder 26, so that the radiating cylinder is heated fully by such flame to radiate infrared rays with high heat content. The burner means may be located at the back of the radiating cylinder 26. However, if the flame is to be ejected sideways into the horizontally lying combustion cylinder 24 by the burner means 33, there will be obtained a thin infrared heater without requiring any special mounting space for the burner means to be provided at the back of the radiating cylinder. In general, the flame ejected from the nozzle of the burner means 33 into the combustion cylinder 24 may not heat the combustion cylinder uniformly through the overall length in the axial direction; the central portion of the combustion or radiating cylinder is more difficult to heat as compared with the end portions. Therefore, in order to intensify the amount of radiation from the central portion of the combustion cylinder to the central portion of the radiating cylinder, it is recommendable to render the ratio of the total area of the apertures 28 bored at the central portion of the combustion cylinder 24 to the surface area higher than that at each end portion, thereby facilitating blowoff of the flame through the apertures 28. In doing this, the number of apertures 28 per unit area at the central portion may be made larger than that at each end portion as shown in FIG. 1, or apertures with larger diameter may be bored at the central portion. FIG. 4 illustrates an example of the latter case. Here the central apertures 28*a* are larger than the adjacent apertures 28*b*, while the apertures 28*b* are formed larger than the apertures 28*c* located at the end portions. Instead of applying such groups of apertures 28*a*, 28*b* and 28*c***, there may be formed apertures increasing gradually in diameter toward the central portion.

Further, it is to be understood that the multilayer cylinder means 22 is not limited to the two-layer configuration and may be constructed in a three- or four-layer form if required. Here the outer radiating cylinder has not only a radiation effect but an effect of heat insulation.

Furthermore, the multilayer cylinder means 22 may be disposed vertically or inclined at a suitable angle instead of being disposed horizontally. In this case, the housing 18 for containing the multilayer cylinder means 22 should preferably be attached to the frame 12 so that the housing 18 may be rocked and fixed at a suitable angle.

The mirror-like reflecting plate 20 may be formed in a parabolic shape with the multilayer cylinder means located in the vicinity of the center thereof. Here the multilayer cylinder means may be either projecting forward, lying horizontally, or standing vertically.

As described above, in the infrared heater according to the invention, there are concentrically disposed the combustion cylinder and the radiating cylinder with a plurality of apertures bored in their respective peripheral surfaces in non radial alignment with each other, and a spray of fuel is ejected from the burner means into the combustion cylinder, so that the flame will never be blown off from the outer radiating cylinder and the temperature of the radiating cylinder, functioning also as an insulating cylinder, will not rise to an excessive degree. Further, the combination of the radiating cylinder and the mirror-like reflecting plate at the back thereof secures radiation of a great amount of heat through a wide angle .

Additionally, this invention may be applied not only to heaters but also to dryers due to its operative effect. In this case, the multilayer cylinder means should preferably be so arranged that the longitudinal direction of an object to be dried is in alignment with the axial direction of the multilayer cylinder means.

What is claimed is:

1. An infrared heater comprising;

a mirror-like, semicylindrical reflecting plate, multilayer cylinder means composed of a combustion cylinder having a plurality of apertures uniformly spaced about the circumference and length thereof and a radiating cylinder having a plurality of offset apertures uniformly spaced about the circumference and length thereof and being in non-radial alignment with the apertures of the combustion cylinder, said multilayer cylinder means being arranged in front of the reflecting plate, and burner means for ejecting a spray of fuel into the combustion cylinder of the multilayer means, whereby no flame through the apertures of the combustion cylinder is blown off to the open air through the apertures of the radiating cylinder.

2. An infrared heater according to claim 1 wherein the burner means is located at the side of the multilayer cylinder means to eject fuel in the axial direction of the multilayer cylinder means.

3. An infrared heater according to claim 2 wherein the ratio of the total area of the apertures of the combustion cylinder to the surface area at the central portion of the combustion cylinder is higher than that at each end portion.

4. An infrared heater according to claim 3 wherein the number per unit surface of the apertures at the central portion of the combustion cylinder is larger than that at each end portion.

5. An infrared heater according to claim 3 wherein the diameter of the apertures at the central portion of the combustion cylinder is larger than the diameter of the apertures at each end portion.

* * * * *